United States Patent [19]

Ford et al.

[11] 4,339,008

[45] Jul. 13, 1982

[54] WELL NOTCHING TOOL

[75] Inventors: Azel R. Ford; David W. Ford, both of Brookville, Pa.

[73] Assignee: D. B. D. Drilling, Inc., Brookville, Pa.

[21] Appl. No.: 157,386

[22] Filed: Jun. 9, 1980

[51] Int. Cl.[3] ..... E21B 29/06

[52] U.S. Cl. ..... 175/272; 166/55.7

[58] Field of Search ..... 175/280, 286, 289, 272; 166/217, 55.7, 55.3, 55.8

[56] References Cited

U.S. PATENT DOCUMENTS

| | | | |
|---|---|---|---|
| 1,358,818 | 11/1920 | Bering | 166/55.7 |
| 1,419,068 | 6/1922 | McFadden | 175/98 |
| 1,663,048 | 3/1928 | Hartson | 175/406 |
| 1,677,507 | 7/1928 | Vock et al. | 166/55.7 |
| 1,788,377 | 1/1931 | Bishop | 175/17 |
| 1,906,771 | 5/1933 | Sandstone | 175/17 |
| 2,188,409 | 1/1940 | Lane | 166/55.7 |
| 2,241,712 | 5/1941 | McNamara | 255/4 |
| 2,516,421 | 7/1950 | Robertson | 255/1.6 |
| 2,611,582 | 9/1952 | Church | 255/1.4 |
| 2,822,148 | 2/1958 | Murray | 255/36 |
| 2,873,950 | 2/1959 | Kandle | 255/4.8 |
| 2,999,572 | 9/1961 | Hinckley | 189/91 |
| 3,489,211 | 1/1970 | Kammerer, Jr. | 166/0.5 |
| 3,799,277 | 3/1974 | Kellner | 175/94 |
| 3,964,555 | 6/1976 | Franklin | 175/44 |
| 4,081,042 | 3/1978 | Johnson et al. | 175/267 |

*Primary Examiner*—James A. Leppink

*Attorney, Agent, or Firm*—Webb, Burden, Robinson & Webb

[57] ABSTRACT

A well notching tool having an elongated rotary power shaft and a coaxial shell in surrounding relationship therewith. A portion of the exterior shell surface is formed with an upwardly directed taper, and a portion of the exterior surface below the taper is formed with threads. A coaxial bell housing surrounds the shell and has internal threads cooperating with the threads on the shell for relative movement of the bell housing and the shell. The bell housing wall has upwardly directed passageways, and a slip is mounted in each passageway for movement in the passageway when contacted by the taper on the shell. A cutting assembly is located at the lower end of the power shaft to rotate with the power shaft. The cutting assembly includes pivotally mounted cutting tool arms actuated upon rotation of the cutting tool assembly to swing outwardly, and a cutting tool is carried at the end of each arm to cut a notch in the sidewall of a well bore.

11 Claims, 4 Drawing Figures

WELL NOTCHING TOOL

Our invention relates generally to a tool for cutting notches in the sidewall of an uncased well bore hole. More specifically, the tool of our invention is adapted to be lowered into a well on a cable to a depth which has been predetermined by logging after which the tool is locked in place so that a notch can be cut at the predetermined depth.

It is often necessary to cut a notch in the sidewall of an uncased well bore hole. One reason for cutting a notch is to open the well at a specific level. Another reason is for effecting various types of well treatment such as hydrofracing.

Our invention is a simple and inexpensive down hole tool for cutting a substantially horizontal notch in the sidewall of an uncased well bore hole. The tool is capable of cutting a single circumferential notch at a time, and it may be used to form any number of vertical spaced notches during a single trip into the bore hole. A notch cut by the tool affords excellent communication between the bore hole and the surrounding formation either for well production or for the injection of cement slurries, fracturing or treating liquids and the like. Our tool forms a notch which insures positive penetration of the formation surrounding the bore hole. The use of our tool eliminates the accumulation of metallic debris in the bore hole which could interfere with subsequent operations.

The tool of our invention is lowered into a bore hole on a cable and does not involve any trips into the hole with pipe as required for some prior art notching tools. The location and operation of our tool are both rapid and inexpensive, and a notch may be located at the desired depth with extreme accuracy. The tool may be lowered into a bore hole on the wire cable which is employed in making usual down hole electrical logs so that it can be accurately positioned. The tool depends from the bottom of a submersible water pump which has a rotatable stub shaft driven by the pump. The tool has a power shaft attached to the pump stub shaft, and the cutting assembly is mounted at the lower end of the power shaft and carries a plurality of arms with cutting tools at their ends for cutting the surface of the hole sidewall to form a notch.

Tools for positioning a notch cutter in a well bore hole are known, but prior art apparatus such as that disclosed in U.S. Pat. Nos. 3,308,893; 2,893,693 and 2,280,769 utilize frictional contact members for positioning the cutter in a well bore hole. Our invention is an improvement over the apparatus disclosed in the aforementioned United States patents as it provides a positive lock between the tool and the surface of the bore hole sidewall. By utilizing our novel tool, the notch cutter will not slip or drop during the cutting operation.

An object of the invention is to provide a down hole inside cutter which can be quickly and easily located in position within the bore hole and firmly locked in place when the pump motor is started. Standard electrical metering equipment such as an ammeter is used to determine the vertical location of the cutting assembly in the bore hole and the completion of the notch in the bore hole sidewall. While the invention is described in connection with cutting a notch in the surface of an uncased hole, it will be understood that our invention may also be utilized to sever casing in a cased bore hole.

Our invention is illustrated in the accompanying drawings in which.

Figure 1:
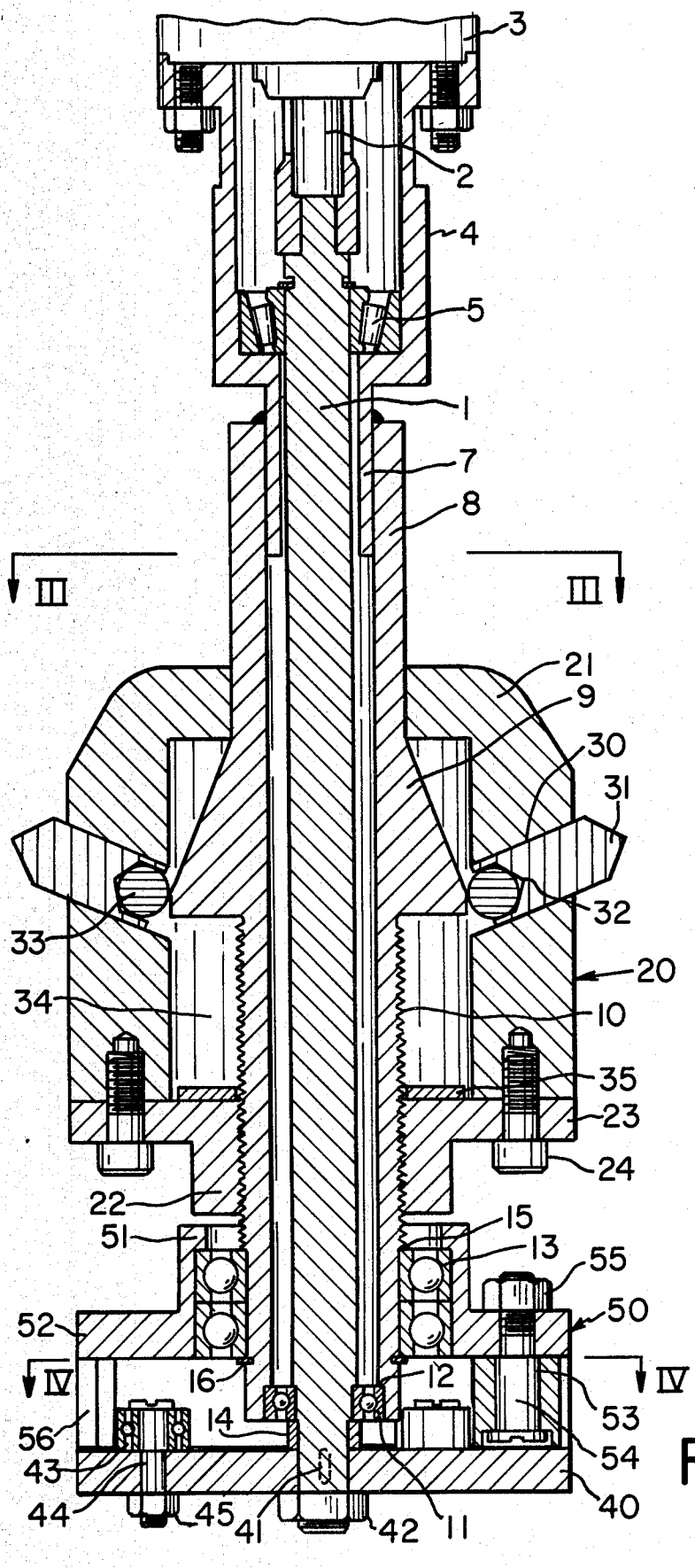
FIG. 1 is a section on line I—I of FIG. 4 with parts in the locked position.
Figure 2:
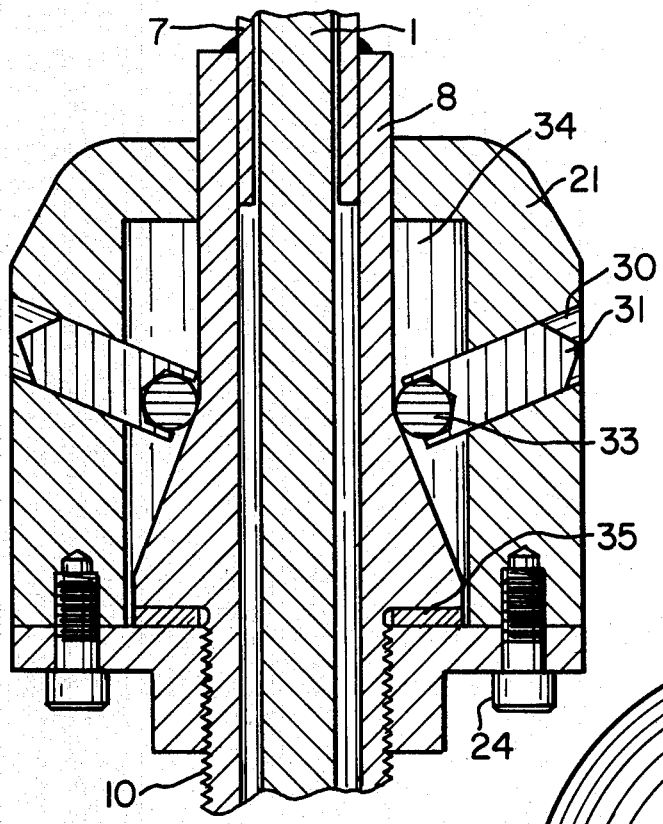
FIG. 2 is a partial section similar to FIG. 1 with parts in the unlocked position.
Figure 3:
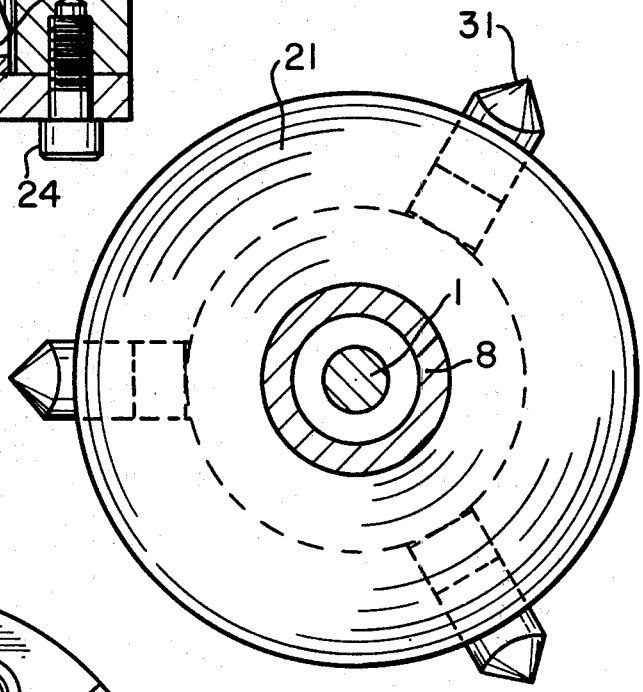
FIG. 3 is a section on line III—III of FIG. 1.

Referring to FIGS. 1 and 2 of the drawings, a rotary power shaft 1 extends downwardly from and is attached to a stub shaft 2 which is driven by a standard submersible water pump 3 which includes an electric motor. A housing 4 is bolted to the bottom of the pump casing and surrounds the connection between stub shaft 2 and power shaft 1. A bearing 5 is located in housing 4 between the housing wall and power shaft 1 to permit rotation of the power shaft relative to housing 4. The housing has a cylindrical extension 7 which is welded to a cylindrical coaxial downwardly extending shell 8 having a portion of its exterior approximately midway between its ends formed with a taper 9. Immediately below the taper the exterior surface of shell 8 is formed with a continuous thread 10 which terminates above the end of the shell. The lower end of shell 8 is maintained in spaced coaxial relation with shaft 1 by a bearing 11 which is seated against a shoulder on shaft 1 and a shoulder 12 at the bottom of the shell. The bearing is held in position against the shoulders by an annular spacer 14 which surrounds shaft 1. The lower end of shell 8 carries exterior bearings 13 which are held in position on the shell against a shoulder 15 by a snap ring 16 fitted into an annular groove in the exterior of the shell. Bearings 11 and 13 permit relative rotation between shell 8 and other members of the tool.

A bell housing 20 having a bell portion 21 and a base 22 is coaxial with shell 8 and is in surrounding relationship with a part of the exterior of the shell above bearings 13. The base of bell housing 20 has internal threads on its vertical leg which cooperate with threads 10 on shell 8 for movement of the bell housing axially along the shell. The base of bell housing 20 also has a horizontally extending flange 23 which receives the lower end of bell portion 21 which is held in position by three bolts 24 which are spaced 120 degrees apart around the flange. The top of bell housing 20 is located above taper 9 of shell 8 as shown in FIGS. 1 and 2 of the drawings.

Angled passageways 30 are located in the wall of the bell portion of housing 20 and are spaced around the housing in the same 120 degree relationship as bolts 24. Each passageway 30 extends upwardly away from the hollow interior chamber 34 of the bell housing and receives a slip 31 which is free to slide along its passageway for a purpose to be described hereinafter. The lower end of each slip 31 is formed with a notch 32 and the outer end is formed with a sharp edge. Each notch carries a roller pin 33. The roller pins are held in notches 32 by their constant contact with the exterior of taper 9 on shell 8 as can be seen in FIGS. 1 and 2. An annular metal bushing 35 is located in chamber 34 of the bell housing on the upper portion of horizontal flange 23.

Figure 4:
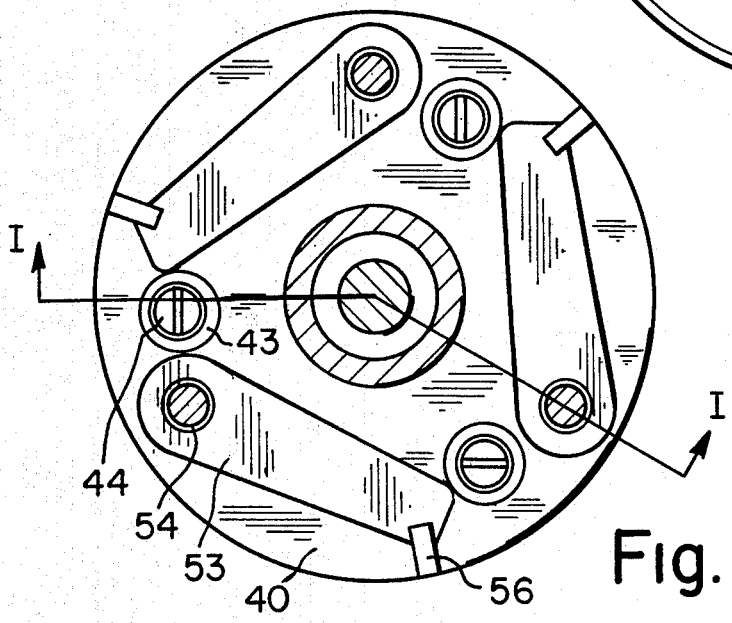
FIG. 4 is a section on line IV—IV of FIG. 1.

The cutting assembly at the lower end of power shaft 1 comprises a circular cutting tool base 40 fixed to the lower end of power shaft 1 by a key and keyway arrangement 41 and a nut 42. The upper surface of cutting tool base 40 is spaced from bearing 11 by annular spacer 14. Cutting tool actuators 43 are supported on the cutting tool base as shown in FIG. 4. Each cutting tool actuator is a bearing mounted on a bolt 44 extending downwardly through base 40 and having a nut 45 fixed to its lower end. The cutting tool actuators are supported on base 40 at 120 degrees of angular spacing, and each actuator is located adjacent to the rear edge of a cutting tool arm 53 when the cutting assembly is stationary. When cutting tool base 40 is rotated by rotation of power shaft 1, each cutting tool actuator contacts an arm to swing the arm outwardly.

A coaxial member 50 is spaced above cutting tool base 40 and is supported by a lip 51 on bearings 13 for rotation relative to shell 8. Member 50 has a horizontal flange 52 which supports cutting tool arms 53. Each arm is pivotally mounted by a bolt 54 and a nut 55 so that it can swing outwardly relative to the center line of member 50 as it is contacted by its actuator 43 when base 40 is rotated. A cutting tool 56 having diamond or carbide particles is mounted in a notch at the end of each arm 53. Upon rotation of shaft 1 the cutting heads will swing outwardly on arms 53 to cut a groove in the surface of a bore hole sidewall equal to the height of the cutting tools 56.

In the position shown in FIG. 1 of the drawings, the bell housing is in its lower position on shell 8 with the slips 31 extending upwardly and outwardly of passageways 30 past the outer surface of bell housing 20 so that the sharp edges contact and penetrate the surface of the bore hole sidewall and hold the notching tool in the desired vertical location in the hole. When it is desired to remove the notching tool from the hole and when the notching tool is initially positioned in the hole at its proper depth, the bell housing has moved axially on threads 10 into the position shown in FIG. 2. As bell housing 20 moves axially along shell 8, the surface of taper 9 permits each slip 31 to be in contact with roller pins 33 which slide along its passageway 30. Thus, when bell housing 20 moves downwardly relative to shell 8, the slips are forced upwardly and outwardly in angled passageways 30 from the position shown in FIG. 2 to the position shown in FIG. 1 so that the sharp edge of each slip penetrates the surface of the bore hole sidewall to lock the tool in position in the hole.

In operation our notch cutting tool is lowered into a well bore hole at the end of a cable which carries electrical connectors connected with electrical indicating apparatus including ammeters which will measure the distance the tool has traveled down the hole and the depth of the notch cut in the sidewall of the hole. The cable is payed out until the cutting tool is at the location in the hole which has been predetermined by logging. A weight indicator is also attached to the cable and at this time it will indicate a full load, i.e. the weight of the cable plus the cutting tool. When the tool is in position, the pump drive motor is started, and centrifugal force will rotate shell 8 relative to bell housing 20 which causes the threads on the shell and the bell housing base to cooperate to move the bell housing downwardly from the position shown in FIG. 2 to the position shown in FIG. 1. The relative movement of shell 8 and bell housing 20 causes taper 9 of the shell to slide slips 31 outwardly and upwardly in passageways 30 to force the sharp ends of the slips into the wall of the hole to lock the cutter at the predetermined vertical location in the hole. After the slips are fully engaged with the surface of the hole, the weight indicator on the cable will show a reduced weight representing only the weight of the cable since the cutter is supported by the slips penetrating the wall of the hole. Continued operation of the pump motor rotates power shaft 1 to rotate cutting tool base 40 in a clockwise direction as seen in FIG. 4 which moves actuators 43 against the rear edge of arms 53 to swing the arms outwardly so that cutting tools 56 bear against the surface to be cut. Continued rotation of cutting tool base 40 rotates member 50 on bearings 13 so that the cutting tools rotate and cut a notch in the hole sidewall at the desired level. It will be seen that at all times force is applied to the cutting tool arms to drive the cutting tools into the surface being notched. This force is amplified by centrifugal force during rotation of member 50 carrying the cutting tool arms. An ammeter indicates the depth of the notch. When the notch is fully cut there is no load on the cutting arms, and the motor is stopped to stop rotation of power shaft 1. The motor is then reversed to rotate shell 8 in the reverse direction, and approximately 90 degrees of rotation will cause relative rotation between the bell housing and the shell on threads 10 to move the bell housing to the position shown in FIG. 2 which permits slips 31 to slide inwardly and downwardly in passageways 30. It will be understood by those skilled in the art that it may be necessary to jiggle the cable to release the slips from their engagement with the sidewall of the hole. Reverse rotation of cutting base 40 will cause the cutting arms to move inwardly by centrifugal force until they are located in the space between horizontal flange 52 and base 40 at which point the cutter assembly may be withdrawn.

While we have described preferred embodiments of our invention herein, it is to be understood that it may be embodied within the scope of the appended claims.

We claim:

1. A notch cutting tool comprising a rotary power shaft, a coaxial shell surrounding said power shaft, said shell having a taper formed on a portion of the exterior surface thereof and an exterior thread formed on a portion thereof adjacent said taper, a bell housing coaxial with and surrounding a portion of said shell including said taper, said bell housing having a base with an internal thread, said internal thread mating with the exterior thread on said shell, said bell housing having a bell portion formed with a plurality of angular passageways, a slip slidably carried in each of said passageways, and cutting means at the lower end of said rotary power shaft for cutting a notch in the sidewall of a hole, said slips contacting said shell taper whereby axial movement of said bell housing relative to said shell causes said slips to slide in said passageways.

2. A notch cutting tool as set forth in claim 1 wherein one end of each of said slips is formed with a notch and a roller pin located in each of said notches to contact the surface of said taper when said bell housing moves axially relative to said shell.

3. A notch cutting tool as set forth in claims 1 or 2 wherein one end of each of said slips is formed with a sharp edge adapted to penetrate the sidewall of a well bore hole.

4. A notch cutting tool as set forth in claim 1 wherein said cutting means includes cutting tool arms pivotally mounted thereon, a cutter located at an end of each of said arms and means to swing said arms about said pivots to force said cutters outwardly from the axis of said rotary power shaft to cut a notch in the sidewall of a hole.

5. A notch cutting tool as set forth in claim 4 wherein said cutting means includes actuators for said cutting arms to swing said arms about said pivots.

6. A notch cutting tool as set forth in claim 5 wherein each of said actuators is a roller bearing.

7. A notch cutting tool as set forth in claim 1 wherein said cutting means includes a cutting tool base attached to the lower end of said rotary power shaft, a member coaxial with and spaced above said base, said member being rotatably mounted on said shell, a plurality of cutting tool arms pivotally mounted on and depending from said member, an actuator for each of said cutting tool arms mounted on said base, a cutter at an end of each of said arms, whereby rotation of said base by said rotary power shaft causes said actuators to swing said arms relative to said member to move said cutters into contact with the sidewall of a well bore hole.

8. A notch cutting tool comprising a rotary power shaft, a coaxial shell surrounding said power shaft, said shell having a taper formed on a portion of the exterior surface thereof, a bell housing coaxial with and surrounding a portion of said shell including said taper, means to move said bell housing axially relative to said shell, said bell housing having a bell portion formed with a plurality of upwardly angled passageways, a retaining slip slidably carried in each of said passageways, means on the inner end of each of said slips contacting the surface of said taper, and cutting means at the lower end of said rotary power shaft for cutting a notch in the sidewall of a hole, said slips contacting said shell taper whereby axial movement of said bell housing relative to said shell causes said slips to slide in said passageways.

9. A notch cutting tool as set forth in claim 8 wherein one end of each of said slips is formed with a notch and the other end is formed with a sharp edge and a roller pin located in each of said notches to contact the surface of said taper when said bell housing moves axially relative to said shell.

10. A notch cutting tool as set forth in claim 8 wherein said means to move said bell housing axially relative to said shell is a thread on the exterior of said shell below said taper and a cooperating thread on the interior of a portion of said bell housing, whereby relative rotation of said shell and said bell housing moves said bell housing axially on said shell.

11. A notch cutting tool as set forth in claim 8 wherein said cutting means includes a cutting tool base attached to the lower end of said rotary power shaft, a member coaxial with and spaced above said base, said member being rotatably mounted on said shell, a plurality of cutting tool arms pivotally mounted on and depending from said member, an actuator for each of said cutting tool arms mounted on said base, a cutter at an end of each of said arms, whereby rotation of said base by said rotary power shaft causes said actuators to swing said arms relative to said member to move said cutters into contact with the sidewall of a hole.

* * * * *